United States Patent [19]

Crawford

[11] 4,355,821

[45] Oct. 26, 1982

[54] DISPLAY BINDER

[75] Inventor: Kenneth Z. Crawford, Crawfordsville, Ind.

[73] Assignee: Crawford Industries, Inc., Crawfordsville, Ind.

[21] Appl. No.: 159,914

[22] Filed: Jun. 16, 1980

[51] Int. Cl.[3] ..... B42D 3/18

[52] U.S. Cl. ..... 281/33; 402/73

[58] Field of Search ..... 402/73; 281/33; 190/16, 190/18 R; 206/45.2, 45.24; 248/441 R, 441 A, 465; D19/26, 27

[56] References Cited

U.S. PATENT DOCUMENTS

| | | | |
|---|---|---|---|
| 575,928 | 1/1897 | Ives | 248/465 X |
| 2,375,190 | 5/1945 | Botts | 281/33 |
| 2,380,780 | 7/1945 | Novak | 281/33 |
| 3,121,576 | 2/1964 | Schade | 248/441 X |
| 3,152,580 | 10/1964 | Tinsler | 281/33 X |
| 3,334,920 | 8/1967 | Orth | 281/33 |

FOREIGN PATENT DOCUMENTS

| | | | |
|---|---|---|---|
| 20166 | 12/1980 | European Pat. Off. | 281/33 |
| 2362145 | 6/1975 | Fed. Rep. of Germany | 281/33 |

*Primary Examiner*—Paul A. Bell

*Assistant Examiner*—John S. Brown

*Attorney, Agent, or Firm*—Jenkins, Coffey, Hyland, Badger & Conard

[57] ABSTRACT

A loose-leaf display binder formed of a cover of flexible sheet material, preferably of one piece and of uniform bendability from top to bottom, which forms front and back cover panels hinged to a spine panel, and also a triangular brace panel hinged to the lower edges of the cover panels and foldable flat against their inner faces to permit the binder to be opened and closed as a book. The binder also includes a stiff spine bar having means such as loose-leaf rings for binding leaves thereto. The upper portion of the spine bar is fixedly connected to the upper portion of the cover spine panel, and the lower portion of the cover is left free to be flexibly bowed rearward away from the lower end of the spine bar to form a rear display support for the binder. The bottom panel is then swung forward and down and connected at its front to the bottom end of the stiff spine bar so as to hold the bottom edges of the cover panel rigidly in alignment and spaced rearward from the lower end of the spine bar, such lower edges and the lower end of the spine bar then forming a highly table support for the binder as an easel for display of its contents.

14 Claims, 6 Drawing Figures

DISPLAY BINDER

This invention relates to display-type loose-leaf binders. Various such binders are known and on the market which comprise front and back cover panels hinged to a spine panel along their inner edges. The spine panel is fixed over a portion of its length to means such as a stiff ring binder assembly for binding leaves in the binder. The cover and spine panels are commonly made of relatively rigid stock such as thick (e.g., 0.165 in.) and stiff polyethylene or other plastic sheet material, or of a series of panels of stiff cardboard or the like enclosed in an envelope of thin plastic sheet stock, and the connections between the cover and spine panels are commonly in the form of continuous hinges provided by heat-scored hinge lines in the thick plastic material or by sealing the thin plastic sheet stock covering of the panels to itself along lines between such panels. Also in such prior display-type binders, the cover and spine panels are formed with at least one continuous hinge line running transversely across the middle of such cover and spine panels. The ring assembly is secured to the spine portion either above or below such transverse hinge line, so that with the covers in open coplanar position, half of the cover and spine panel assembly can be hinged away from the stiff ring assembly to form a dihedral angle with the other half of such assembly.

In some cases, as in U.S. Pat. No. 3,121,576, the upper half of such assembly is left free from the rigid ring binder assembly and is swung downward through, say, 110° to an angular easel-support position and means is provided to hold it in such position to support the ring assembly and lower half of the cover assembly as an easel for display of the binder contents. In other cases, it is the bottom half of the cover and spine assembly which is left free from the ring assembly and this is swung rearward, and means is provided to limit its rearward movement so that it and the lower end of the ring assembly will support the ring assembly and upper half of the cover as an easel for display of the binder contents.

Such prior art binder assemblies require the use of rigid stock or a stiff construction for the cover and spine panels and require the presence of a transverse hinge line across the faces of the covers which is undesirable from an appearance standpoint and interferes with desired cover decoration and printing. Despite the use of rigid cover and spine panels, such binders are not entirely stable when loaded to capacity or when the contents are swung from one side to another in use. The required heavy construction also makes them relatively expensive and bulky.

It is an object of the present invention to provide an improved display-type loose-leaf binder which provides a more stable and rigid display stand in use, which does not require the presence of a transverse hinge line across the faces of the cover panels, which is made of relatively thin gauge sheet material so as to provide a more attractive, less bulky, and less expensive display binder and which has improved capabilities.

In accordance with the present invention, the binder cover is made of flexible sheet material comprising a cover sheet forming front and back cover panels and a spine panel to which the front and back cover panels are hingedly interconnected along their inner edges, preferably by continuous integral hinges. The cover also includes bottom brace panel means, preferably a triangular panel which is hinged at its base to the bottom edges of the front and back cover panels and desirably also to that of the spine panel. In normal use of the binder as a book, the bottom brace panel folds flat against the inner face of the cover panels, and is provided with hinge lines aligned with those of the cover panels, or is otherwise formed so that the front and rear covers can be opened and closed in the usual way of book covers. A stiff spine bar having means such as binder rings for binding leaves thereto is interconnected to an upper portion, conveniently the upper half, of the spine panel, while the lower portion of the spine panel is left free. The bottom brace panel, in folded position, lies beneath the free lower portion of the spine bar. This leaves the lower portion or half of the cover sheet forming the cover and spine panels free, when in open position, to have its lower edges displaced rearward to a rear support position. The bottom brace panel is then swung forward and downward about that lower edge to which it is hinged, to a generally horizontal position, and its front edge is fixed to the lower end of the stiff spine bar, so as to hold such lower end in spaced relation with the rearwardly swung lower edge of the cover sheet.

The bottom brace panel then forms a dihedral angle with the bottom edge of the cover sheet, such bottom edge is stiffened and held substantially in a straight line so as to form a firm and broad rear support for the display position of the binder. Further, since the bottom brace panel is preferably a continuous sheet extending from the whole length of that lower edge forward to the central connection with the lower end of the spine bar, such spine bar lower end is not only held in forward-spaced relation but also firmly braced against relative lateral movement. Preferably, as noted above, there is no transverse hinge line across the cover sheet which forms the cover and spine panels, and the cover sheet is of uniform bendability from top to bottom so that rearward displacement of the bottom edge of that sheet below its connection to the upper portion of the rigid spine bar causes that sheet to be flexibly bowed in a vertical arc from its bottom edge forward and upward to the mid-portion of its height where it merges with the upper portion of such sheet which is fastened to the rigid spine bar. The result is that the upper portion is held in a highly stable outspread position so as to form a quite stable support of the leaves contained in the binder. The further result is that the faces of the cover panel are mechanically uninterrupted by any necessary hinge line and present a continuous surface for the reception of uninterrupted decoration or printing as may be desired.

To best meet the requirements of the binder thus described, the front and back cover panels, the spine panel, and the bottom brace panel are all made of a single sheet of sheet material such as polyethylene or other plastics material having similar properties. Such material is adapted to have integral hinges formed therein by heat scoring along single or double score lines. The sheet can and should be thin enough, for example 0.040 inch thick, so that with the bottom panel in folded position and with its hinge lines overlying those of the cover panels, it will not interfere with the hinging movement of the cover panels and they will freely open and close as the covers of a book. The sheet material also can and should be sufficiently flexible to be flexibly bent or bowed by the rearward displacement of the lower edge of the cover sheet, yet sufficiently stiff that the bowed cover panels will form a firm easel support for the contents of the binder, and the bottom panel will form a stiff brace panel from its hinge line connection with the bottom edge of such cover sheet forward to the bottom end of the stiff spine bar.

The accompanying drawings illustrate the invention, and show an embodiment exemplifying the best mode of carrying out the invention as presently perceived. In such drawings.

Figure 1:
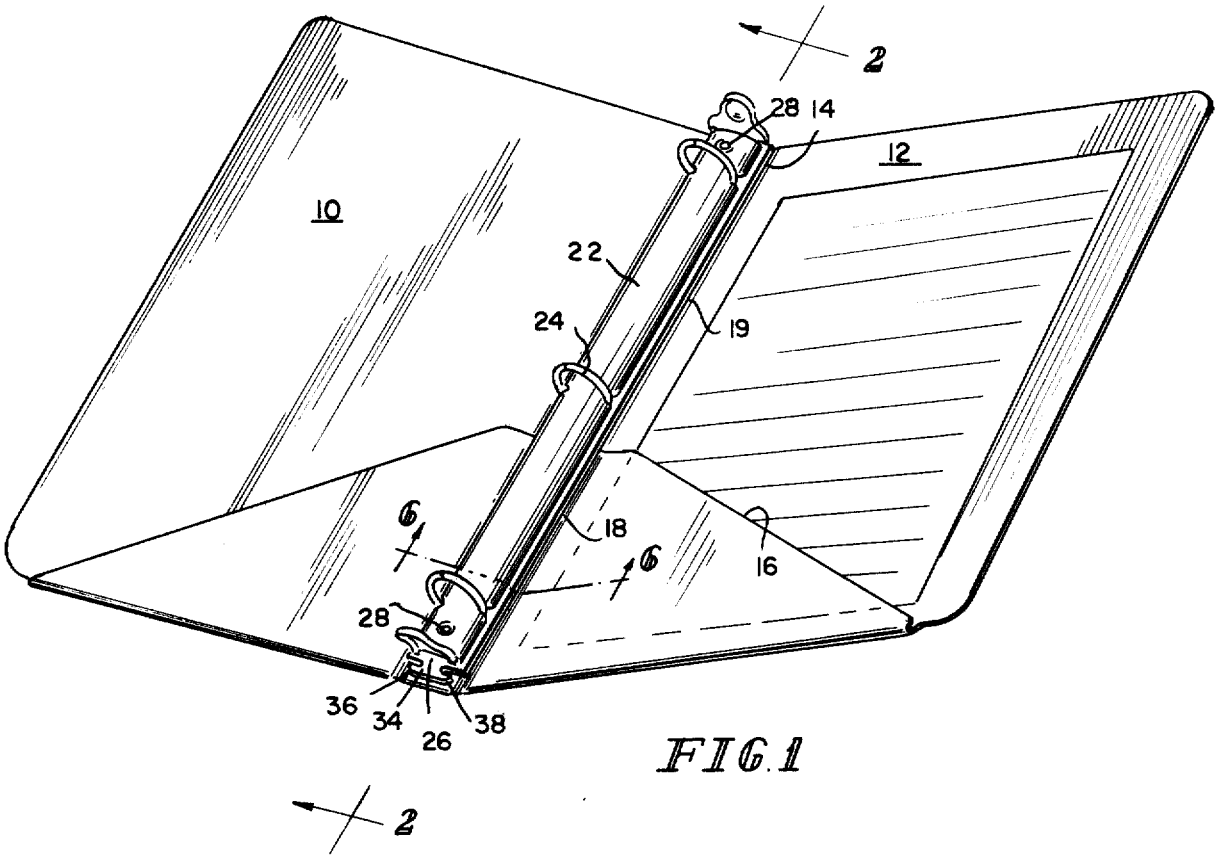
FIG. 1 is a perspective view of a partially open binder in its normal book-like condition.

The display binder shown in the drawings comprises a cover sheet forming a front cover panel 10, a rear cover panel 12, and a spine panel 14 to which the cover panels are connected at their inner edges by continuous integral hinge lines. A bottom brace panel 16 is connected to the bottom edges of the panels 10, 12, and 14 and folded up so as to lie flat against the inner faces of those panels. In this condition, the brace panel forms a temporary pocket for holding loose sheets as shown in FIG. 1. The bottom brace panel shown is generally in the form of a wide isosceles triangle hinged to the cover sheet at its base and having its apex lying upward against the spine panel. While this is preferred, other shapes may be used, such as a rectangle having one long side hinged to the cover sheet or semicircular with its chordal side hinged to the cover sheet. It should have portions hinged to the bottom edges of the covers so that in erected position they are stiffened and held outspread to form a rear easel support and held rearward relative to the bottom end of the spine bar which forms the front easel support.

Figure 6:
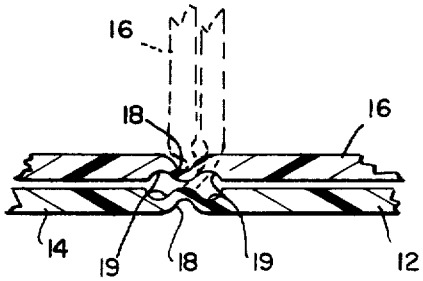
FIG. 6 is a partial section taken on the line 6—6 of FIG. 1 showing the heat score lines forming hinge lines in the bottom brace panel and the cover sheet in their overlying folded position.

The connections between the several cover panels are in the form of continuous integral hinges formed by heat score lines as shown in FIG. 6. As there shown, the hinge between the back cover panel 12 and the spine panel 14 is formed by a central score line indentation 18 from the bottom and a pair of closely spaced score line indentations 19 at opposite sides of the bottom indentation, so as to form a thin and flexible hinge portion of wavy configuration. Polyethylene plastics sheet material is especially adapted to form such integral hinge lines, but certain other sheet material, such as polypropylene, has similar characteristics. In the brace panel 16, the same hinge score lines 18 and 19 are formed while the cover sheet is in flat planar condition, and when the brace panel 16 is folded up against the inner face of the cover sheet, the positions of such indentations are reversed. This facilitates the concurrent bending of the overlying panels as the rear cover panel is moved from open position shown in full lines to closed position relative to the spine panel as shown in dotted lines. Thus, the indentation 18 at the inside of the bend tends to close up while that at the outside of the bend opens up, and this allows the bending to take place with substantially no relative movement of the overlying panels. The continuous hinge line between the bottom brace panel 16 and the cover sheet is similar, but preferably includes spaced indentations which are more widely spaced so as to accommodate some relative sliding of the adjoining panels.

The spine panel 14 carries a binder ring assembly 22 of standard construction having a series of rings 24, here shown as three rings 24, for binding leaves contained in the binder. Conveniently, this is fastened in closely spaced relation to a spine-reinforcing strip 26 by means of rivets 28 and spacers 30 at the ends of the ring assembly 22. Such assembly 22 and the reinforcing strip 26 form what may be referred to as a spine bar, and it will be understood that this may include different forms of ring assemblies and that in some cases the ring assembly may be of such form and stiffness that it will itself serve both as leaf ring-binding means and spine bar without the addition of a reinforcing strip 26 as shown.

Figure 2:
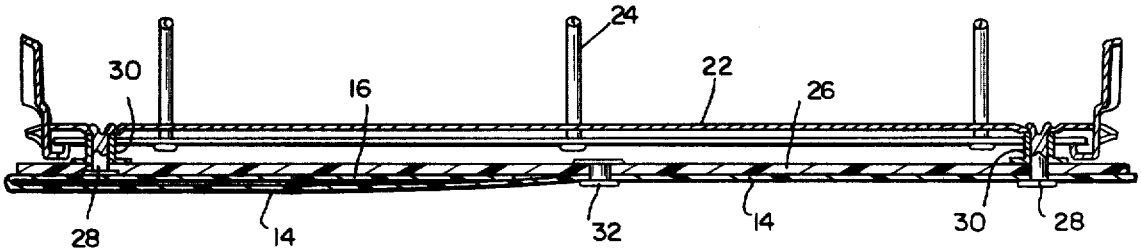
FIG. 2 is a section taken on the line 2—2 of FIG. 1.
Figure 4:
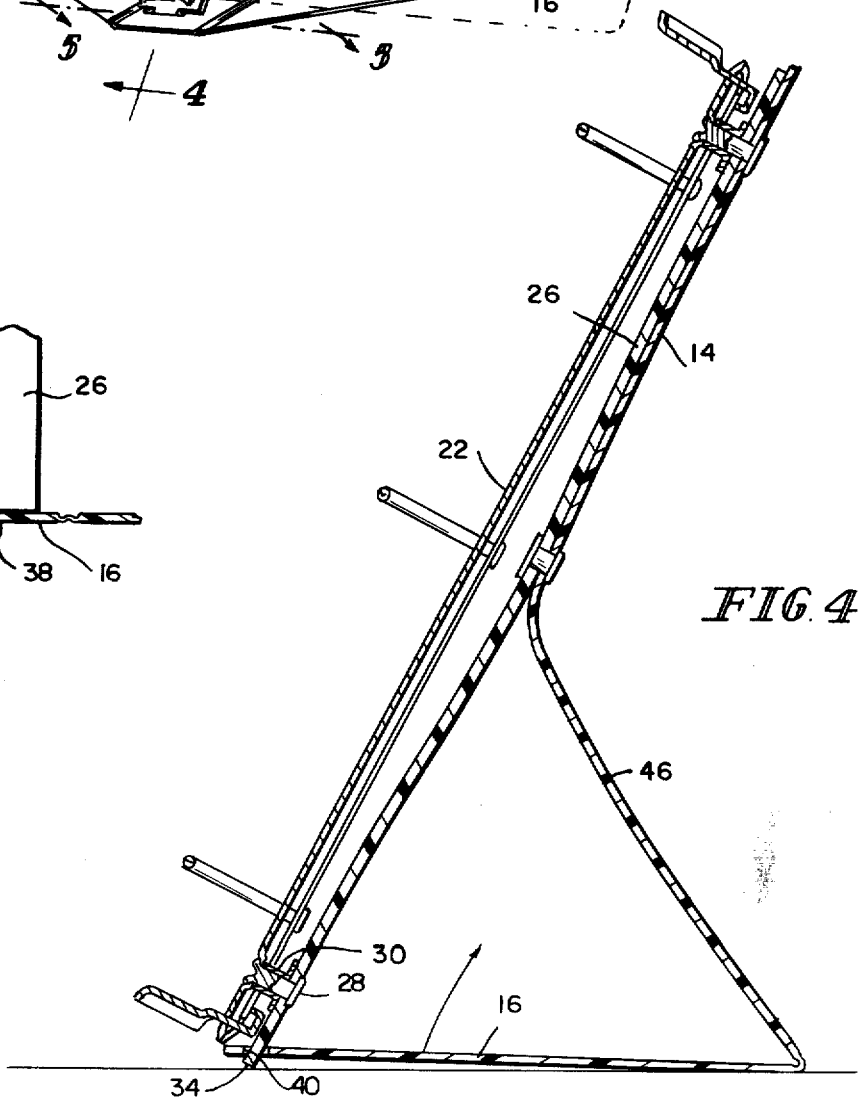
FIG. 4 is a section taken on the line 4—4 of FIG. 3.

The spine bar 22, 26 is fixedly connected to the spine panel 14 over an upper portion thereof, preferably the upper half, by the upper rivet 28 and by a middle rivet 32 which need not engage the ring assembly. The lower half of the spine bar is left free from the lower half of the spine panel 14 so that the spine portion of the bottom brace panel 16 may be folded flat against the inner face of the bottom half of such spine panel 14 and beneath the spine bar 22, as shown in FIG. 2, and may be swung downward therefrom to its brace position as shown in FIG. 4. With the binder in the condition shown in FIGS. 1 and 2, the front cover panel 10 and rear cover panel 12 may be swung freely about the hinge lines 18, 19 between open and closed positions as book covers. With the cover sheet formed of polyethylene sheet stock having a thickness of the order of 0.040 inch and with hinge lines as shown in FIG. 6, the overlying brace panel and cover sheet swing between such open and closed positions without noticeable relative slipping or distortion and lie flat in each position.

Figure 3:
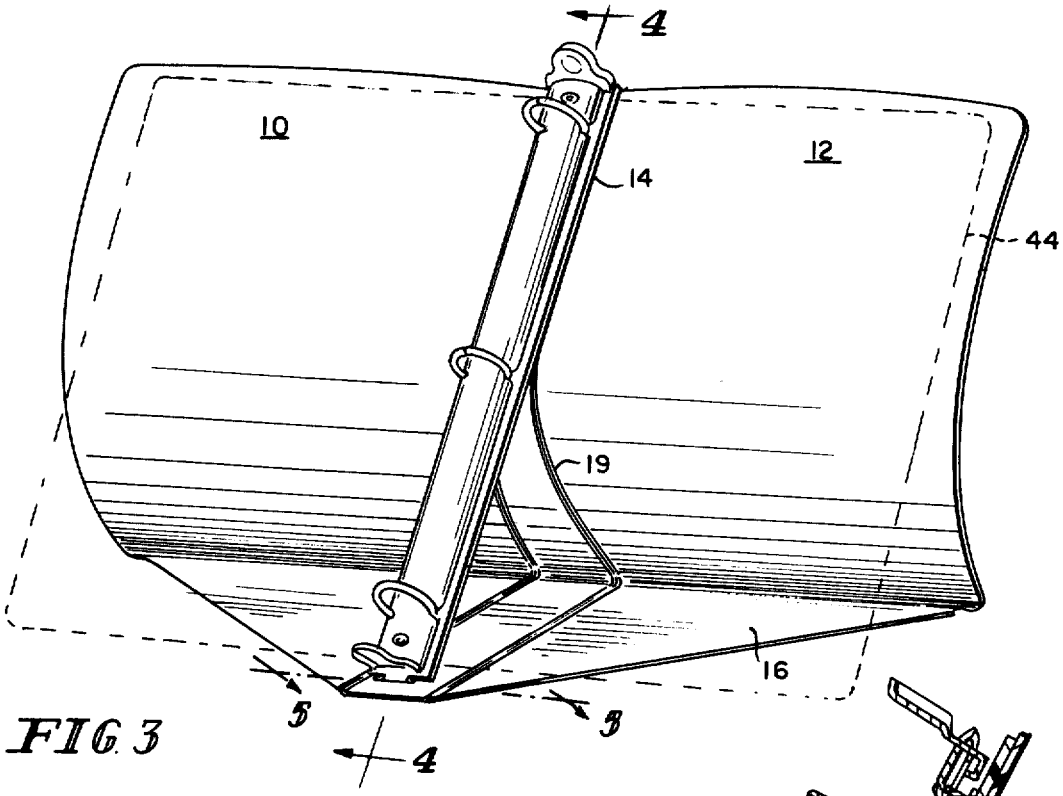
FIG. 3 is a perspective view of the binder of FIG. 1 in erected condition as a display easel.
Figure 5:
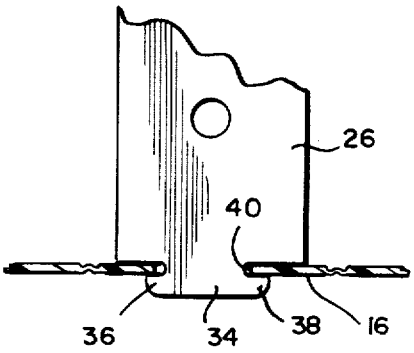
FIG. 5 is a section taken on the line 5—5 of FIG. 3 showing the tongue and slot connection between the bottom end of the spine bar and the forward end of the bottom brace panel.

When it is desired to erect the binder to its display position as shown in FIGS. 3 and 4, the cover panels 10 and 12 are opened so that the cover sheet lies flat, the lower edge of the cover sheet is displaced rearward from the lower end of the spine bar 22, 26, and the bottom brace panel is then swung forward and down and its free edge connected to the lower end of the spine bar. Conveniently, such connection is as shown in FIG. 5. To form such connection, the lower end of the reinforcing strip 26 is formed with a T-shaped tongue 34 having a short lateral wing 36 and a longer lateral wing 38, and the free edge of the brace panel 16 is formed with a slot 40 of a length slightly greater than the distance from the end of the wing 36 to the bottom of the notch below the wing 38. The tongue is engaged in such slot by first entering the long wing 38 through the slot, moving the tongue laterally to the right so that the opposite wing 36 will clear the opposite edge of the slot 40 and such wing 36 is then passed through the slot to the position shown in FIG. 5.

In this erected position, the continuous hinge connection between the brace panel 16 and the lower edges of the cover panels 10 and 12 and spine panel 14 holds those lower edges in a straight line and displaced rearward from the lower end of the spine bar. To accommodate such rearward displacement of its lower end, the cover sheet is flexibly bent or bowed rearward so as to take a curved cross section which at the spine is somewhat distorted, as shown in FIG. 4, but which toward the outer edges of the cover panels 10 and 12 is more nearly arcuate. This curved condition of the stiffly flexible cover sheet supports the upper portions of the cover panels 10 and 12 is an open supportive position for supporting leaves contained in the binder, as indicated by the leaves 44 shown in dotted lines in FIG. 3. This results in a sturdy display condition for the binder. While the cover sheet has sufficient flexibility to be bowed rearward as shown, the bowed configuration provides good support for the upper portion of the cover panels 10 and 12 so that they provide good support for the leaves contained in the binder. The bottom brace panel 16 of the sheet material is not subjected to bending stress, and tends to lie flat and thus to firmly support the bottom edges of the cover sheet in a straight line, and to fix the lower end of the spine bar against relative displacement with respect to such lower edge of the cover sheet, not only against displacement normal to such edge, but also displacement laterally. The binder is returned from its easel display condition of FIGS. 3 and 4 to its normal book configuration of FIG. 1 by disconnecting the interlocked ends of the spine bar 22 and the brace panel 16 and folding that brace panel upward against the cover sheet, as indicated by the arrow in FIG. 4.

Such lower end of the spine bar and such lower edge of the cover sheet are thus made to form a solid base for the erected binder. The binder is thus held with substantial rigidity, and while it is to some extent subject to rearward tilting about the bottom end of the spine bar because of the bowed configuration of the rear brace portion 46 (FIG. 4), such rear brace is in effect formed by the entire width of the cover panels 10, 12, and 14 and is thus of substantial strength to support a heavy load of leaves contained in the binder.

I claim:

1. A display binder, comprising a cover sheet of sheet material forming front and back cover panels and a spine panel to which the front and back cover panels are hingedly interconnected along their inner edges, and bottom brace panel means hingedly interconnected to the bottom edges of the cover panels, said cover sheet being of flexibly bendable material of substantially uniform bendability from top to bottom, so that rearward displacement of the bottom edge of the cover sheet with the cover panels in open position causes such sheet to bow rearward in a vertical arc, a stiff spine bar having loose-leaf binding means for binding leaves thereto, means connecting the upper portion of the spine bar to the upper portion of the spine panel, the lower portion of the cover sheet being free to be swung rearward away from the lower end of the spine bar to displace the bottom edge of such sheet rearward to form a rear display support for the binder, the brace panel means being movable between a folded position flat against the inner face of said cover panels to allow opening and closing of the binder as a book and a brace position extending forward from such bottom edges of the cover panels to the spine bar, in which brace position it holds such bottom edges in predetermined outspread relation and in rearward spaced relation from said bar for supporting the open binder as an easel for display of its contents, and means for connecting the front of the bottom brace panel means to the spine bar in such brace position.

2. A display binder as in claim 1 in which said brace panel means is a laterally continuous panel including a central spine portion which overlies the lower portion of the spine panel when in folded position, and wing portions overlying the front and back panels and connected to the spine portion by hinge lines overlying the hinge lines between the spine and cover panels.

3. A display binder as in claim 2 in which said connecting means comprises a slot in the spine portion of the brace panel and a tongue on the spine bar which interlocks with the slot.

4. A display panel as in claims 1 or 2 in which the brace panel means is in the form of a wide isosceles triangle hinged at its base to the bottom edge of the cover sheet.

5. A display binder, comprising a cover sheet of flexible sheet material forming front and back cover panels and a spine panel to which the front and back cover panels are hingedly interconnected along their inner edges, and bottom brace panel means hingedly interconnected to the bottom edges of the cover panels, a stiff spine bar having loose-leaf binding means for binding leaves thereto, means connecting the upper portion of the spine bar to the upper portion of the spine panel, the lower portion of the cover sheet being free to be swung rearward away from the lower end of the spine bar to displace the bottom edge of such sheet rearward to form a rear display support for the binder, the brace panel means being movable between a folded position flat against a face of said cover panels to allow opening and closing of the binder as a book and a brace position extending forward from such bottom edges of the cover panels to the spine bar, in which brace position it holds such bottom edges in predetermined outspread relation and in rearward spaced relation from said bar for supporting the open binder as an easel for display of its contents, and means for connecting the front of the bottom brace panel means to the spine bar in such brace position, the cover sheet being flexible and of substantially uniform bendability from top to bottom so that its lower portion will be bowed rearward in a vertical arc as its lower edge is displaced rearward to its display support position, such material being sufficiently stiff that when so bowed the cover sheet forms substantially stable outspread supporting surfaces for the contents of the binder.

6. A display binder as in claims 2 or 5 in which the cover sheet and brace panel are sufficiently thin that when the brace panel is folded flat against the cover sheet the covers will open and close as a book without substantial relative movement of the overlying panels.

7. A display binder as in claim 6 in which the hinge lines between the cover portions and spine portions of the cover sheet and brace panel comprise a central indentation on that side of the sheet which lies at the outer faces of the folded cover sheet and brace panel, and a pair of spaced indentations in the other side of the sheet and at opposite sides of the central indentation, the central indentation in the brace panel being adapted to close as the covers are moved from open to closed condition and the central indentation in the cover sheet being adapted to open as the covers are so moved so as to minimize relative movement between the overlying panels during such opening and closing.

8. A display binder as in claim 5 in which the cover panels have mechanically uninterrupted surfaces extending substantially the full height of the covers for the reception of uninterrupted decoration or printing.

9. A display binder, comprising a cover sheet of flexible sheet material forming front and back cover panels and a spine panel to which the front and back cover panels are hingedly interconnected along their inner edges, and bottom brace panel means hingedly interconnected to the bottom edges of the cover panels, a stiff spine bar having loose-leaf binding means for binding leaves thereto, means connecting the upper portion of the spine bar to the upper portion of the spine panel, the lower portion of the cover sheet being free to be swung rearward away from the lower end of the spine bar to displace the bottom edge of such sheet rearward to form a rear display support for the binder, the brace panel means being movable between a folded position flat against a face of said cover panels to allow opening and closing of the binder as a book and a brace position extending forward from such bottom edges of the cover panels to the spine bar, in which brace position it holds such bottom edges in predetermined outspread relation and in rearward spaced relation from said bar for supporting the open binder as an easel for display of its contents, and means for connecting the front of the bottom brace panel means to the spine bar in such brace position, said spine bar comprising a ring binder assembly and a reinforcing strip of flexible material, the ring binder assembly being connected to the strip adjacent its ends and the strip being connected to the spine panel at spaced points along the said upper portion thereof.

10. A display binder as in claim 9 in which said brace panel means is a laterally continuous panel including a central spine portion which overlies the lower portion of the spine panel when in folded position, and wing portions overlying the front and back panels and connected to the spine portion by hinge lines overlying the hinge lines between the spine and cover panels.

11. A display binder of the type comprising a cover sheet forming front and back cover panels and a spine panel to which the cover panels are hingedly connected at their inner edges, a stiff spine bar having loose-leaf binding means for binding leaves thereto, and means connecting the upper portion of the spine bar to the upper portion of the spine panel, the lower portion of the cover sheet being free to be swung rearward to displace its bottom edge rearward to form a rear display support for the binder, wherein the improvement comprises that the cover sheet is of flexibly bendable material of substantially uniform bendability from top to bottom, so that rearward displacement of the bottom edge of the cover sheet with the cover panels in open position causes such sheet to bow rearward in a vertical arc, and means connected to the bottom edge of the cover sheet for stiffening the bottom edges of the cover panels and holding such panel edges in predetermined outspread relation and in rearwardly spaced relation with the bottom end of the spine bar so that such panel edges and lower end of the spine bar support the binder as an easel for display of its contents.

12. A display binder as in claim 11 in which said means connected to the bottom edge of the cover sheet comprises bottom brace panel means hinged to the bottom edges of the cover panels, and adapted to be folded flat against such cover panels to permit the cover panels to be opened and closed as in a book.

13. A display binder of the type comprising a cover sheet forming front and back cover panels and a spine panel to which the cover panels are hingedly connected at their inner edges, a stiff spine bar having loose-leaf binding means for binding leaves thereto, and first means connecting the upper portion of the spine bar to the upper portion of the spine panel, the lower portion of the cover sheet being free to be swung rearward to displace its bottom edge to form a rear display support for the binder, wherein the improvement comprises that the cover sheet is of flexibly bendable material of substantially uniform bendability from top to bottom, so that rearward displacement of the bottom edge of the cover sheet with the cover panels in open position cases such sheet to bow rearward in a vertical arc, that second means is connected to the bottom edge of the cover sheet for stiffening the bottom edges of the cover panels and holding such panel edges in predetermined outspread relation and in rearwardly spaced relation with the bottom end of the spine bar so that such panel edges and lower end of the spine bar support the binder as an easel for display of its contents, said second means connected to the bottom edge of the cover sheet comprising a bottom brace panel hinged by substantially continuous hinge means to the bottom edge of the cover sheet and including a spine portion and wing portions connected thereto by hinge lines, said brace panel being foldable against the inside face of the free lower portion of such cover sheet, between the same and the overlying lower portion of the spine bar, its hinge lines thus overlying those of the cover panels to permit opening and closing movement of the cover panels, and being swingable forward from such folded position to a brace position, and third means for connecting the free edge of said brace panel to the spine bar to hold the parts in easel-support position.

14. A display binder, comprising a cover having front and back cover panels hingedly interconnected along their inner edges so as to open and close as a book, and bottom brace panel means hingedly connected to the bottom edges of the cover panels, a longitudinally stiff loose-leaf binder assembly extending along the hinged interconnection between the panels, first means connecting the upper portion of said assembly to the upper portion of the hingedly interconnected covers, the lower portions of the covers being free to be swung rearward away from the free lower end of said assembly to displace their bottom edges rearward to form a rear display support for the binder, the brace panel means being movable between a folded position flat against the inner face of said cover panels to allow opening and closing of the binder as a book and a brace position extending forward from the bottom edges of the cover panels to the free lower portion of the binder assembly, in which brace position the brace panel means holds such bottom edges in predetermined outspread relation and in rearward spaced relation from the bottom of the binder assembly for supporting the open binder as an easel for display of its contents, and second means for interconnecting the front of the bottom brace panel means and the binder assembly to hold the same in easel-forming position.

* * * * *